US006071027A

United States Patent [19]

Gueret

[11] Patent Number: 6,071,027

[45] Date of Patent: Jun. 6, 2000

[54] APPLICATOR-HOLDER

[75] Inventor: Jean-Louis H. Gueret, Paris, France

[73] Assignee: L'Oreal, Paris, France

[21] Appl. No.: 09/068,022

[22] PCT Filed: Aug. 13, 1997

[86] PCT No.: PCT/FR97/01489

§ 371 Date: Sep. 11, 1998

§ 102(e) Date: Sep. 11, 1998

[87] PCT Pub. No.: WO98/09548

PCT Pub. Date: Mar. 12, 1998

[30] Foreign Application Priority Data

Sep. 2, 1996 [FR] France ..... 96 10687

[51] Int. Cl.[7] ..... A45D 40/06; B43K 21/08

[52] U.S. Cl. ..... 401/75; 401/68; 401/98

[58] Field of Search ..... 401/75, 76, 68, 401/70, 52, 98

[56] References Cited

U.S. PATENT DOCUMENTS

| | | | |
|---|---|---|---|
| 3,197,024 | 7/1965 | Bau . | |
| 3,232,275 | 2/1966 | Ziegler et al. | 401/68 X |
| 3,358,699 | 12/1967 | Bau | 401/70 |
| 4,603,989 | 8/1986 | Ackerman et al. | 401/98 X |
| 4,820,070 | 4/1989 | Spatz | 401/68 X |
| 4,954,000 | 9/1990 | Gueret | 401/75 X |
| 4,997,299 | 3/1991 | Ohba | 401/75 |
| 5,009,534 | 4/1991 | Gueret | 401/75 |
| 5,018,892 | 5/1991 | Krueckel et al. | 401/75 X |
| 5,230,577 | 7/1993 | Cox et al. | 401/68 |
| 5,336,005 | 8/1994 | Moeck et al. | 401/75 X |
| 5,407,286 | 4/1995 | Powers | 401/68 |
| 5,423,623 | 6/1995 | Bakic | 401/75 X |
| 5,533,823 | 7/1996 | Pierpont et al. | 401/98 |
| 5,829,900 | 11/1998 | Brown et al. | 401/68 X |
| 5,879,093 | 3/1999 | Ohba et al. | 401/68 |

FOREIGN PATENT DOCUMENTS

| | | |
|---|---|---|
| 337867 | 10/1989 | European Pat. Off. . |
| 382594 | 8/1990 | European Pat. Off. . |
| 604793 | 7/1994 | European Pat. Off. . |
| 4222759 | 1/1994 | Germany . |
| 4340067 | 5/1994 | Germany . |

*Primary Examiner*—Henry J. Recla
*Assistant Examiner*—Kathleen J. Prunner
*Attorney, Agent, or Firm*—Oblon, Spivak, McClelland, Maier & Neustadt, P.C.

[57] ABSTRACT

An applicator holder device including a holder and a pusher mechanism. The pusher mechanism can be actuated so as to pass selectively from a rest position inside the holder into an active position. The pusher mechanism is able to drive an applicator that can be displaced in translation in an axial duct arranged in a head mounted in a detachable manner on the holder. The pusher mechanism can be automatically returned to its rest position when the head is removed from the holder.

36 Claims, 8 Drawing Sheets

APPLICATOR-HOLDER

BACKGROUND OF THE INVENTION

1. Field of the Invention

The invention concerns an applicator holder device that can be used in particular, but not exclusively, in the cosmetic field, using for example, a kohl pencil lead, a liner, lipstick, eyeshadow etc. Within the meaning of the present Application, the term "applicator" encompasses applicators for direct application (a lead), as well as applicators for indirect application (a flocked or not flocked foam, a felt, pencil brush etc.).

2. Discussion of the Background

In the field of cosmetics, mechanisms are known which comprise a handle with a central pusher component actuated by a screw thread to allow a "lead" to be selectively advanced or retracted, so as to lower or push up a "lead" disposed in the head (or nose) of an applicator, the "lead" being carried by a cup. The cup is held in position inside by a spring in the rest position. When the nose is mounted on the handle and when the pusher is actuated, it pushes the "lead" out of the head while decompressing the spring. The term "lead" is used here to denote any elongate mass or stick of consumable cosmetic product.

A major drawback relates to the fact that if the refill nose is removed in the course of use without re-screwing back the pusher mechanism, the "lead" enters back into the nose, but the pusher remains in its high position, then requiring a manipulation for returning it into its low position. Moreover, since the pusher mechanism is actuated by a screw thread arranged on the internal surface of the holder, it is difficult to give the pencil a shape other than a circular shape, because of the material thicknesses produced. Finally, such mechanisms use a large number of components, which considerably increases the cost of these devices.

Other applicator holder devices are also described in U.S. Pat. No. 3,358,699, or in EP-A-0604793 or DE-A-4222759. The devices described in these documents are of the type comprising a threaded stem with which one or several tabs are brought to engage, so as to drive the applicator into its emerged position. However, due to the mechanism driving it, this kind of device poses problems mainly because the applicator is held axially rigidly in position, which inevitably produces in the application process a certain lack of softness which is perceived by the users as a defect when the device is used for applying make-up products in zones as sensitive as those surrounding the eyes.

Moreover, in EP-A-0604793 and U.S. Pat. No. 3,358,699, the drive mechanism which constitutes a fragile part of the device is carried, not by the detachable head, but by the body, or by an intermediate manipulating element, which requires the replacement of the whole of the device if the drive mechanism becomes damaged.

Finally, in the case of DE-A-4222759, the driving part of the mechanism is caused to engage with the threaded stem substantially at its centre during the mounting of the head on the body of the device. Because of the small annular spaces, this makes it necessary for the drive means to forcibly pass in their strained position over a substantial portion of the thread, which forcible passing substantially affects the ease and softness of the assembly and use of the device, and there is moreover, the risk of irremediable damage being caused to either the drive mechanism or the thread, or both.

SUMMARY OF THE INVENTION

Thus it is one of the objects of the present invention to create an optionally refillable applicator holder which is not subject to the drawbacks mentioned above with reference to the conventional devices.

It is, in particular, an object of the invention to provide an applicator holder device, wherein the applicator is driven by a simple, reliable mechanism and which lends the application process a gentleness and softness that are improved as compared with conventional devices.

It is, in particular, an object of the invention to provide an inexpensive mechanism that is simple to mount and capable of having any shape, and which advantageously makes it possible to cause the pusher mechanism to return automatically into its rest position when the head is being removed from the holder.

Other objects will become apparent in detail in the description that follows.

In accordance with the invention, these objects are attained by means of a device comprising: a holder wherein there is mounted a pusher mechanism capable of coming to engage with drive means, for passing selectively from a rest position inside the holder to an active position, wherein the pusher mechanism is able to drive an applicator capable of displacement in translation in an axial duct arranged in a head detachably fitted on the holder; and means for automatically producing the disengagement of the drive means from the pusher mechanism when the head is removed from the holder, and causing the pusher mechanism to pass from the active position to the rest position under the effect of an axial force exerted by restoring means, characterized in that the drive means have a resilience of which an axial component exerts on the pusher mechanism, in the position engaged with the drive means, an axial restoring force in an opposite direction to the axial force exerted by restoring means, in response to an axial pressure exerted on the pusher mechanism via the applicator.

Thus mounted, the pusher mechanism, and hence the applicator, are mounted as on a spring so that during the application when the free end of the applicator is caused to bear on the surface to be treated, the applicator can resiliently recoil, so as to absorb a part of the exerted pressure, thus increasing the softness in the application. The applicator returns into position by being resiliently restored when the pressure stops.

According to a preferred embodiment, the drive means are formed by at least one element formed of two parts of which a first part is joined to the head on which it is mounted with radial resilience, so as to selectively allow during the mounting of the head (or during its removal) the engagement (or the disengagement) of the drive means with or from (respectively) the pusher mechanism, a second portion joined to the first, capable of coming into engagement with the pusher mechanism, and having an axial resilience for generating the axial restoring force.

Advantageously, the drive means are carried by the head, which makes it possible to give them a larger radial width, thus increasing their resilience in the axial direction. Moreover, in the case of any damage to the whole or part of the drive system, only the detachable head has to be changed, and not the holder. Finally, this characteristic makes it possible to use a stem having a deep, thick thread and allowing the applicator to be quickly advanced.

Again advantageously, the drive means are arranged so as to produce the disengagement of the drive means from the pusher mechanism and the passing of the pusher mechanism from the active position to the rest position when the axial pressure exerted on the pusher mechanism exceeds a given value. This characteristic makes it possible to prevent the "lead" from being damaged in the case of an unduly high pressure exerted on its end, as for example, when the drive is accidentally dropped.

Again advantageously, the device comprises:

a) a hollow cylindrical holder closed at one of its ends;

b) a stem threaded over at least a part of its length and mounted for free translation inside the holder, the stem being secured against rotation inside the holder;

c) resilient restoring means mounted inside the holder, so as to keep the threaded stem in the rest position biased against the closed end of the holder;

d) a detachable head wherein there is arranged an axial duct intended to receive an applicator mounted in a cup, the said duct being open at its two ends, with the first end opening out towards the outside for the application of the product, and the second end allowing the head to be detachably fitted on the holder;

e) a drive system carried by the head or by the holder, so as to be placed into engagement with the thread of the stem when the head is being fitted on the holder, so as to produce the driving of the applicator in translation in the said duct by rotation of the holder relative to the head; and f) means for permitting the disengagement of the drive system and of the stem during the removal of the head.

The stem may be threaded over whole, or part of its length. Preferably, however, the stem is threaded over a portion delimited by a first limit situated on the opposite side to the holder and by a second limit, the drive means comprising a meshing part capable of coming into engagement with the thread of the stem and being positioned in such a way that, when the head is being fitted on the holder, the meshing part is substantially opposite the first limit. Thus in its strained position the meshing part is not caused to pass over any substantial portion of the thread, which would, in fact, inevitably cause damage to the thread or the drive means. Moreover, between the second limit and the end of the stem situated in the bottom of the holder, the stem may have a portion whose diameter is substantially equal to the diameter of the bottom of the thread.

Thus, according to this advantageous arrangement, when the head is being fitted on the holder the drive system comes firstly into contact with the stem at any start of the thread of the stem, even (at least in the case of one of the tabs) over an unthreaded part thereof.

Coupling means may be provided between the stem and the applicator, with a view to driving the applicator into the axial duct of the head, the mounting of the head on the holder causing the drive system to engage with the threaded stem, but it does not cause the applicator to be driven in the duct; the applicator only comes into play during the first use of the device by rotation of the head relative to the holder. Thus, during the mounting of the head, the position of the applicator is constant which prevents an unduly large length of the applicator from emerging during the mounting, which could cause damage to the applicator. In other words, the engagement of the drive system with the threaded stem is disconnected from the engagement of the stem and the applicator.

According to a preferred embodiment, the stem has, at its opposite end to the closed end of the holder, a fastening end fitting and the cup has fastening means intended to cooperate in a detachable manner with the fastening end fitting of the stem so as to allow the applicator to be driven into the duct, a rotation of the holder relative to the head causing the applicator to be driven in translation in the duct and the stem to be fastened to the cup by the closing of the fastening means on the end fitting and rotation of the holder in the opposite direction relative to the head causing the applicator to rise in the duct, means being provided for releasing the stem from the cup by opening the fastening means when the applicator has risen again inside the duct, while keeping the applicator in position inside the duct. According to a preferred embodiment, the applicator is only disengaged from the stem in the retracted position of the applicator. For this purpose, when the head is removed in the run out position of the applicator, the drive system is disengaged from the threaded stem before disengaging the stem from the cup, it only being possible for this latter disengagement to occur in the retracted position of the applicator.

Sealing means may be provided in the vicinity of one and/or the other of the ends of the axial duct. In particular, in the case of a lipstick, these sealing means comprise a block of foam which is compressible in all spatial directions and has one side is intended to come in a leakproof bearing contact on a free edge of the head, the said side being impermeable to the solvent (or solvents) forming part of the composition of the applicator, the block of foam being disposed in the bottom of a cap capable of covering, in a detachable manner, an opening delimited by the free edge.

The means provided for releasing the stem from the cup comprise a frustoconical portion formed inside the head, adjacent to the said axial duct, the frustoconical portion allowing the fastening means to diverge by being resiliently biased when the holding means arrive opposite the said frustoconical portion, thus releasing the stem. When the fastening means are in an elastic bearing contact on its sides, this frustoconical portion allows the applicator to be kept in its retracted position inside the duct.

The means provided for releasing the stem from the cup may further comprise a groove adjacent to the frustoconical portion, so as to allow the fastening means to diverge further, the tabs, in fact, diverging by resilience and entering at least in part into the grooves. This characteristic is particularly advantageous in the case of a lipstick, whose diameter is larger as compared with certain other applicators.

At its opposite end to the head, the stem may comprise guide means capable of sliding inside a groove arranged in the internal side of the holder.

Means may be disposed between the guide means of the stem and the closed end of the holder, so as to damp the impact of the stem on the bottom of the holder when the stem returns under the action of the resilient means. Such an arrangement also offers the advantage of reducing the noise and the vibrations produced by the recoil of the stem against the bottom of the device, in a resilient biasing mode.

The damping means may be carried by the guide means and/or by the bottom forming the closed end of the holder. Such damping means are formed by a leaf spring obtained by moulding, together with the piece of which they form part, by an overmoulded elastomeric element or by a block of foam.

Advantageously, the closed end of the holder has an attached bottom having an opening for the escape and/or renewed intake of air, thus allowing any piston action phenomenon to be avoided. The attached bottom may be catch engaged, bonded, welded or screwed on.

According to a preferred embodiment, the resilient restoring means comprise a helical spring disposed inside the holder. Such a spring may have one of its ends bearing against the guide means of the stem, the other end bearing against an annular flange disposed on the internal side of the holder.

According to a preferred embodiment, the drive system has at least one element having a first portion orientated substantially along the longitudinal axis of the device, and a meshing second portion of which a free end is intended to come into engagement with the threaded stem, the first portion being capable of resiliently pivoting round an axis substantially perpendicular to the longitudinal axis so as to selectively allow during the mounting of the head (or during its removal) the engagement (or the disengagement) of the free end with or from (respectively) the threaded stem, the second portion having a resilience generating in the position engaged with the drive means an axial restoring force in a direction opposed to the direction of the restoring force generated by the restoring means, in response to an axial pressure exerted on the stem via the applicator.

By way of an indication, the resilience of the second portion is such that under the effect of an axial pressure exerted via the applicator, the stem is axially displaced by a distance of from 0.2 mm to 2 mm.

Preferably the second portion forms an angle relative to the first of from 30° to 120°, and preferably from 45° to 110°.

The second portion may have a radial width of from 1.5 mm to 3 mm.

Advantageously, the drive system comprises at least two tabs capable of coming into engagement with the stem at at least two diametrically opposite points. Preferably, the two points are axially offset, so as to permit a faster engagement of the drive system and of the stem.

In a particular embodiment, the tabs have substantially the shape of an L or a V whose tip is orientated towards the outside of the holder, corresponding holes being arranged in the internal side of the head for freeing the tabs during the removal of the head and thus producing the disengagement of the tabs and stem.

Advantageously, means forming a stop are provided for limiting the axial movement of the applicator in the direction towards the second end of the head in the detached position of the head. Preferably, the stop is arranged in such a way that it does not require any indexed position of the cup, for acting as a stop.

The tabs may be carried by an annular element intended to be mounted on the head, this annular element also carrying the means intended to form a stop for the applicator. The annular element may be formed by a single piece obtained by moulding a thermoplastic material.

According to another embodiment, the drive system includes a slotted screw nut carried by the head.

The coupling means may comprise at least two resiliently deformable tabs mounted on the cup, the tabs having a shape capable of tightly gripping the end fitting of the stem when it pushes the applicator inside the duct. Advantageously, the tabs have a resilient configuration close to that of the tabs for driving the stem, so that advantageously they can also perform the function of a damping element.

At its opposite end to the head, the holder may carry a pencil sharpener. The pencil sharpener may be detachable or non-detachable. In the latter case, it may be catch engaged, bonded or welded inside a recess arranged in the bottom of the holder.

The holder may have a square, oval, triangular, circular or polygonal shape. The applicator may be constituted by a "lead", a pencil brush, a felt, a lipstick, a foam or a flocked applicator. The product to be applied may be a lipstick, a colouring, a mascara, a liner, a kohl, an eyeshadow etc.

The mechanism in accordance with the invention is particularly advantageous in that when a "lead" is used up, the lead-carrying mechanism is ready to receive a new refill without requiring any additional manipulations to position the refill. The softness on application is outstanding.

BRIEF DESCRIPTION OF THE DRAWINGS

In the description that follows, reference will be made to the drawings wherein.

DISCUSSION OF THE PREFERRED EMBODIMENTS

Figure 1:
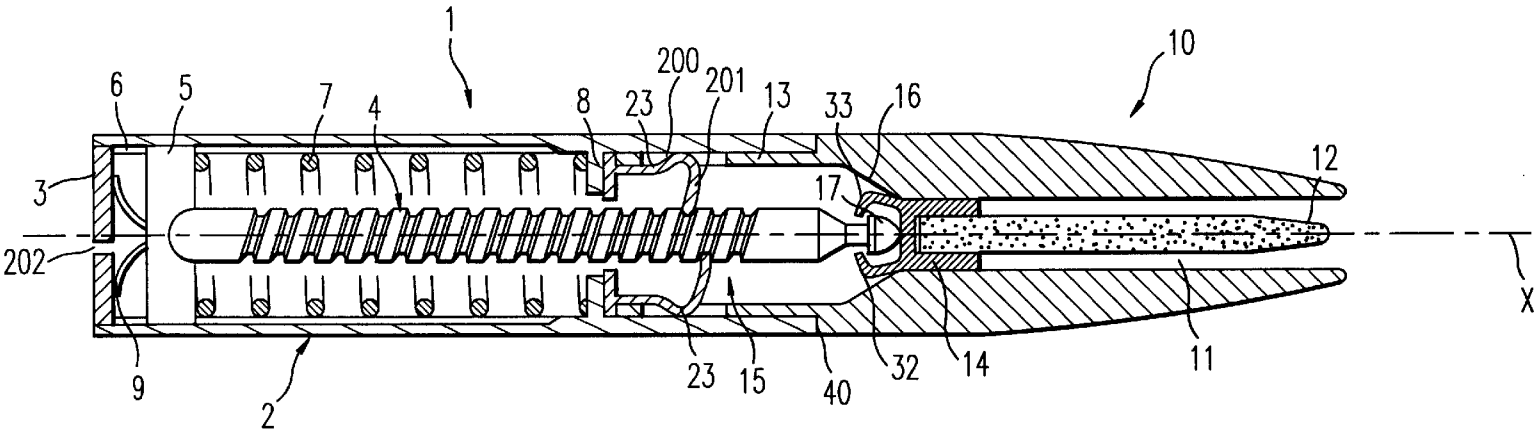
FIG. 1 shows a cross-sectional view of a first embodiment of the device in accordance with the invention.

As shown in FIG. 1, the applicator holder device 1 in accordance with the invention mainly comprises a holder 2 forming the body of the device of a substantially cylindrical shape, having a longitudinal axis X, and closed at one of its ends by a cap or bottom 3 which can be welded to the holder, or be mounted on the holder by catch engagement or bonding. Advantageously, an opening 202 is provided in the cap so as to allow a renewed intake of air during the withdrawal of the applicator with a view to an application of the product. The pusher mechanism is mounted inside the holder 2 and comprises, in essence, a stem 4 which is threaded (over at least a portion of its length). The stem 4 is situated substantially in the axis of the holder, and is fixed to a head 5 (of the winged type). The head 5 is guided in translation in the holder by means of grooves 6, arranged in a suitable manner in the internal surface of the holder, the stem being thus secured against rotation. The stem is, moreover, mounted inside the holder by means of a spring 7 (of the helical type), one of whose ends bears on an annular flange 8 arranged inside the holder, and whose other end bears on the head 5 of the stem 4. Thus, in the rest position, the stem is held biased against the closed end of the holder. Advantageously a spring system 9, of the leaf-type for example, is disposed on the head of the stem on the side situated opposite the cap 3, the function of the spring system being to reduce the sound and damp the impact produced by the return of the stem (under the action of the spring 7) when the head is being removed from the holder, as will be seen in greater detail in the continuation of the description. Other means, such as for example a pad of an elastic material, may be used in accordance with the invention, to replace the spring mechanism 9. According to a preferred embodiment, the free end of the stem 4 opposite the head 5 comprises an end fitting 17 forming a part with an extra thickness as compared with the diameter of the stem. The shape of the end fitting may be a rounded, conical or any other shape and, as will be set out below, allows the stem to be fastened to the lead.

Figure 4A:
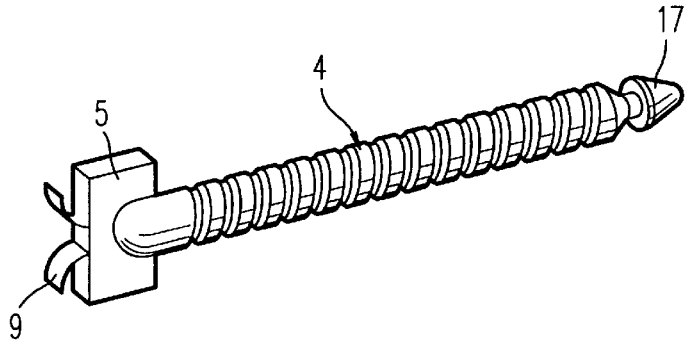
FIGS. 4A–4B illustrate two embodiments of the pusher mechanism used in the applicator holder device in accordance with the invention.
Figure 4B:
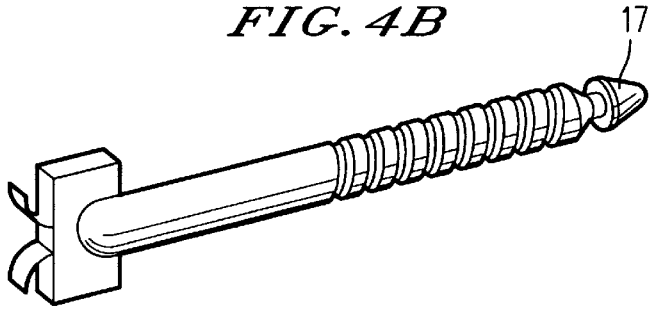

As will be seen in FIGS. 4A and 4B, the stem may have a thread over its whole length (FIG. 4A) or, over only a portion of its length (FIG. 4B), the spring thus being used to re-engage the device when the stem has returned to its initial position. As will be seen in detail below, the location and limits of the threaded system are determined in such a way that when the head 10 is being fitted on the holder 2 the meshing part of the tabs 23 comes into engagement with the thread right at the start of the thread, so as to limit the number of turns of the thread to be passed over by the strained tabs.

The device in accordance with the invention also comprises a head (or nose) 10 of a general elongate shape, preferably tapered at one of its ends, and inside which there is disposed an axial duct whose diameter is adapted to the diameter of an applicator, such as a "lead" 12 advantageously carried by a cup 14 and intended to be mounted inside the duct. The opposite end to the tapered portion of the head has a part 13 whose external diameter is slightly less than the internal diameter of the holder 2, so that it can be mounted therein in a detachable manner, the edge of the holder coming to bear against a shoulder 40 of the head. Advantageously, the external surface of the part 13 has an annular groove intended to cooperate by catch engagement with an annular rib arranged on the internal surface of the holder in order to improve the hold of the head on the holder during the use of the lead holder device. In its portion on the opposite side to the tapered end, the axial duct 11 opens out in a portion with a larger diameter 15 to which it is joined by a zone 16 of a frustoconical shape.

The head of the device in accordance with the invention also has drive means 23 intended to come into engagement with the thread of the screw, during the mounting of the head on the holder, in order to cause the stem to advance (or retract) by rotation of the head relative to the holder; as is shown more clearly in FIGS. 5B to 5E, these means 23 are carried by an annular element 21, a portion of which has an external diameter slightly smaller than the internal diameter of the portion 13 with the smaller diameter of the head 10, so that it can be mounted by catch engagement, by welding, by bonding or by any other technique inside the portion 13. The other end 22 of the annular element forms a flange with a diameter slightly larger than the internal diameter of the portion 20, so as to come to bear against the transverse edge of the portion 13. On the transverse edge of the portion 20 there are disposed two tabs 23 that are resiliently deformable and are intended to be positioned opposite the corresponding holes 24 that are arranged in the side of the head 10. In the mode of embodiment shown, the tabs define an L or V shape the apex of which is orientated towards the outside so as to be inserted, in the absence of any constraint, in the holes 24. In the removed position, the top of the tabs emerges substantially through the holes 24 in the way shown in FIG. 5C.

Figure 2:
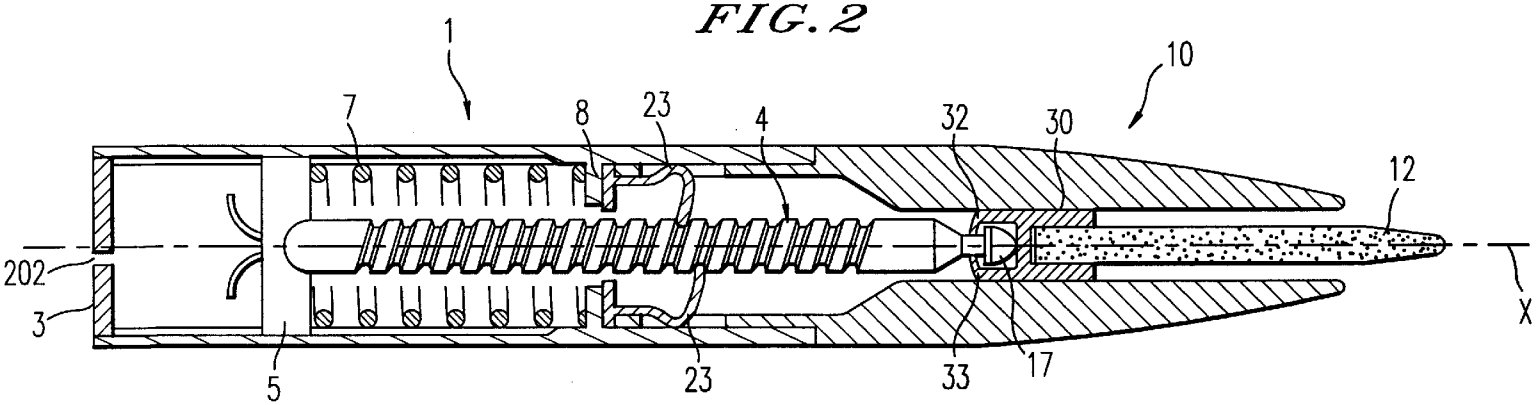
FIG. 2 is another illustration of the device of FIG. 1, wherein the "lead" is joined to the pusher mechanism, so that it can be displaced in the application position.

Thus, as is shown in FIGS. 1 and 2, when the head is fitted on the holder, the sides of the holder bear on the top of the drive tabs 23, so as to force them into engagement with the threaded system of the stem 4, to form a screw nut and to be capable of driving the stem in one direction or the other depending on the direction of rotation of the head relative to the holder.

According to a main characteristic of the invention, the drive tabs 23 form a resiliently deformable structure of which the portion 201, when engaged with the stem, imparts an axial resilience to the positioning of the stem and hence of the applicator driven by the stem. In the embodiment shown, the stem is driven by two tabs 23 disposed at two diametrically opposed points relative to the stem. Alternatively, and although this solution does not constitute the preferred solution, the drive of the threaded stem can be effected with a single tab 23. Advantageously, the engagement points of each of the tabs 23 are slightly offset axially (for example by of the order of one turn of the thread).

Each one of the tabs has the overall shape of an L, having a first portion 200 which in the fitted position of the head is substantially parallel to the longitudinal axis X of the device. One end of the portion 200 is joined to the annular element 21 (described with reference to FIGS. 5B and 5C), mounted on the head 10. The other end is joined to a portion 201 which is substantially perpendicular thereto and whose free end is intended to come into engagement with the threaded stem 4. The portion 200 of each of the tabs 23 is situated opposite a corresponding hole 24 which is capable of allowing, by a resilient restoring action, the disengagement of the tabs 23 from the threaded stem when the head is being removed. In fact, when the head is removed the tabs 23 are no longer constrained by the internal wall of the body of the device. The tabs 23 have a resilience of which a radial component produces, by a resilient restoring action, the pivoting of the portion 200 substantially round an axis A (FIG. 5B) perpendicular to the longitudinal axis X of the device. The portion 200 penetrates, at least partially, into the corresponding slot 24 (see FIG. 5C).

The portion 201 then moves away substantially radially relative to the stem 4, which action releases the stem which returns to its rest position in the bottom of the device under the effect of the restoring force exerted by the spring 7.

The portion 201, which during the mounting of the head is situated substantially in the vicinity of the start of the thread, has a radial width which can range from 1.5 to 3 mm. This portion 201 has an axial resilience which is such that, when an axial pressure is exerted on the applicator (for example when the applicator bears on a surface to be treated), the resiliently deformable portion 201 slightly closes over the portion 200 (by a bending movement substantially around axis B) which produces a small axial backward movement of the free end of the tabs 23 (in the direction towards the bottom of the holder). The stem moves back in the same way then, by a resilient restoring force generated by the portion 201, it returns to its initial position. Typically the rearward movement may range from 0.2 mm to 2 mm. This resilience depends to a large extent on the material used (preferably a thermoplastic material), on the radial width of the portion 201 and on the angle between the portion 200 and the portion 201, (preferably, close to 90°). Thus mounted, the stem 4 and hence in consequence the applicator 12, are mounted as on a spring, which imparts a remarkable softness to the application. Obviously, the tabs 23 must be sufficiently rigid to drive the stem in opposition to the restoring force exerted by the spring 7.

Moreover, it is to be noted that, advantageously, if the pressure exerted on the applicator (for example by its being dropped) is too great, the impact creates a stronger folding back movement of the portion 201 on the portion 200, that is to say a more substantial closing of the angle between the portion 201 and the portion 200. This more substantial folding back produces a disengagement of the tabs 23 from the stem which returns into its rest position in to the bottom of the holder by a resilient restoring action. This advantageous characteristic limits the risks of accidental damage to the applicator tip.

During assembling of the head, which corresponds substantially to the position illustrated in FIG. 1, the cylindrical portion 13 is inserted into the open end of the holder 2. This having been done, the tabs 23 are constrained by the internal surface of the holder, which produces their engagement with the start of the thread of the stem 4. At this stage, it should be noted that the applicator is not yet driven by the stem, the drive only being effected during the first use by turning the head 10 relative to the holder 2. Thus, each time a new head 10 is fitted on the holder, the positioning of the applicator is constant. In other words, the assembling of the head (and engagement of the drive tabs 23 and of the stem 4) is an operation disconnected from the drive of the applicator with a view to an application.

Figure 5A:
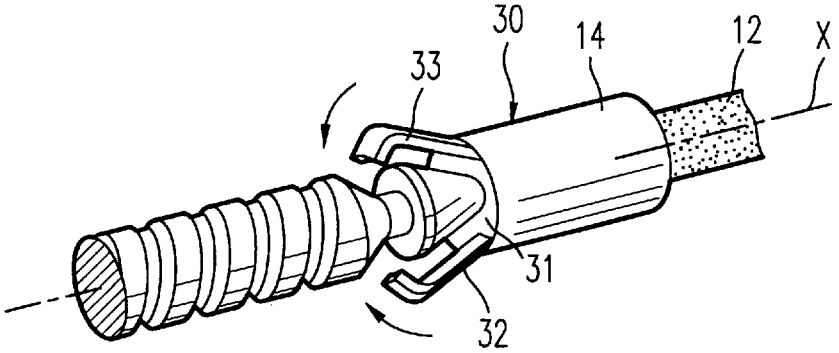
FIGS. 5A–5G schematically illustrate various drive elements of the device in accordance with the invention.
Figure 5B:
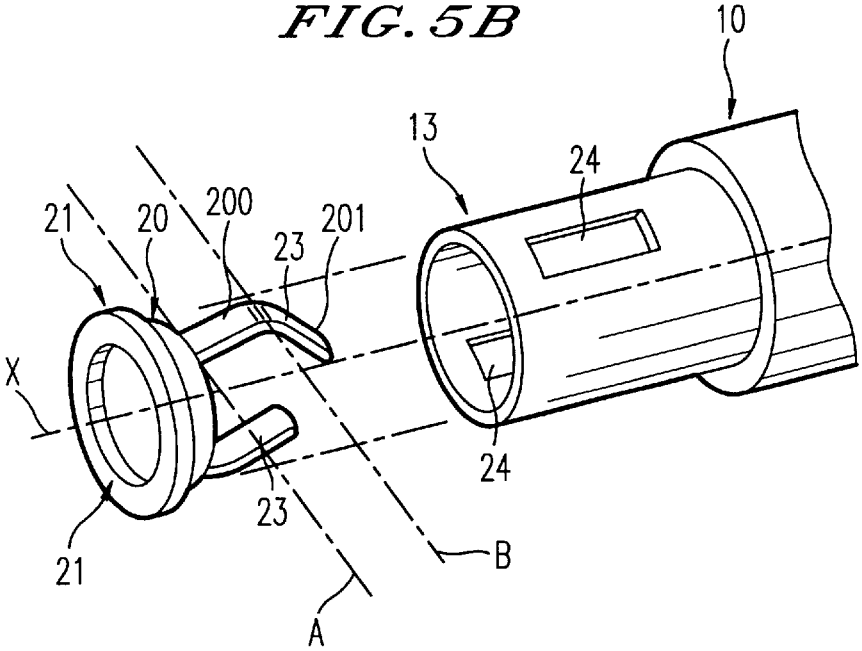
Figure 5C:
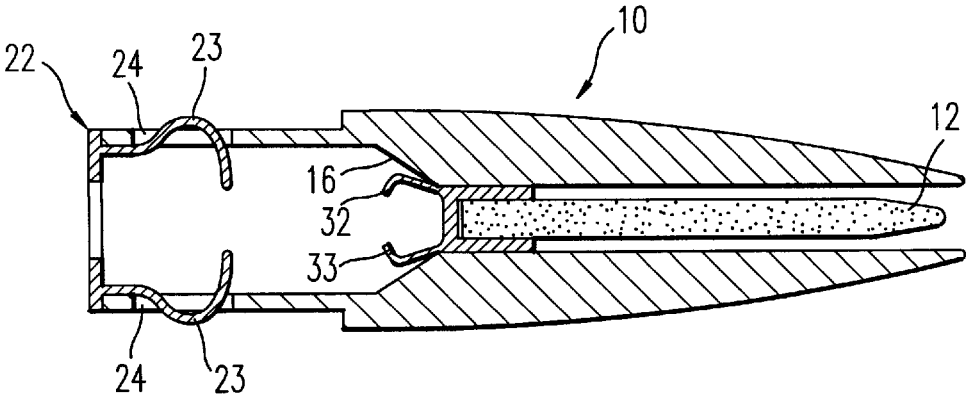

The tabs 23 may be made of metal, plastic or any other material providing the desired resilience. In the embodiment illustrated, the tabs 23 have a shape close to that of an L. In reality, their shape is close to that of an L in a strained position (FIGS. 1 and 2) and close to that of a V in an unstrained position (FIGS. 5B–5E). According to an advantageous embodiment, the tabs 23 are obtained by moulding a thermoplastic material (polyethylene or polypropylene) in a single piece with the element 21 supporting them, as depicted in FIG. 5G.

When the head is removed from the holder (for example by pulling), the tabs 23 resiliently return into their divergent position, thus disengaging from the threaded stem 4 which can then return into its rest position by the action of the spring 7.

Figure 5D:
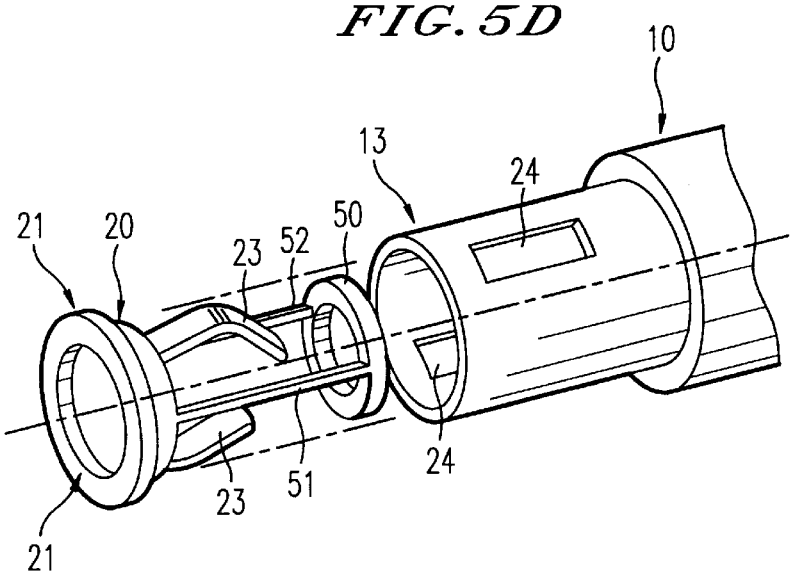
Figure 5E:
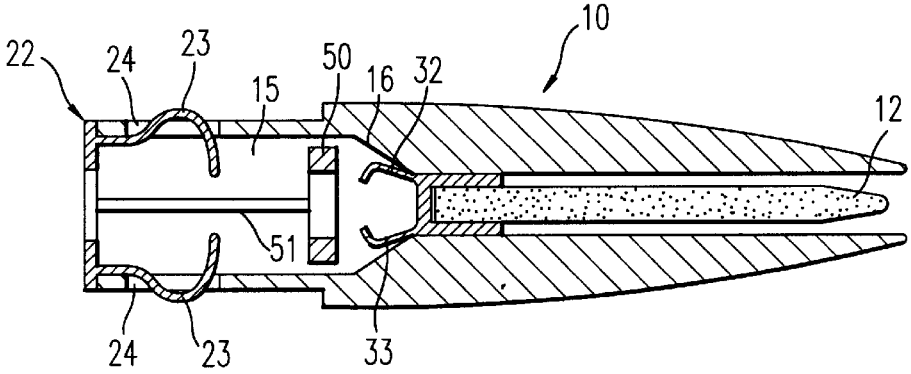

In the embodiment of FIGS. 5D and 5E, the annular element 21 also carries a ring 50 connected to the part 20 by two arms 51, 52 disposed at 90° relative to the drive tabs 23. The internal diameter of the ring is such that the stem 4 and the end fitting 17 can freely pass through, so as to be capable of coming into engagement with the tabs 32 and 33 of the cup 14. However, the internal diameter of the ring 50 is such that, when the part 21 is inserted into the head 10 (see FIG. 5E), the ring forms an annular stop which prevents the "lead" 12 from emerging from the head 10 through the opening delimited by the portion with the larger diameter 15, the length of the arms 51, 52 being chosen so that in the retracted position of the "lead", the ring 50 is situated in the vicinity of the free end of the tabs 32, 33.

Figure 5F:
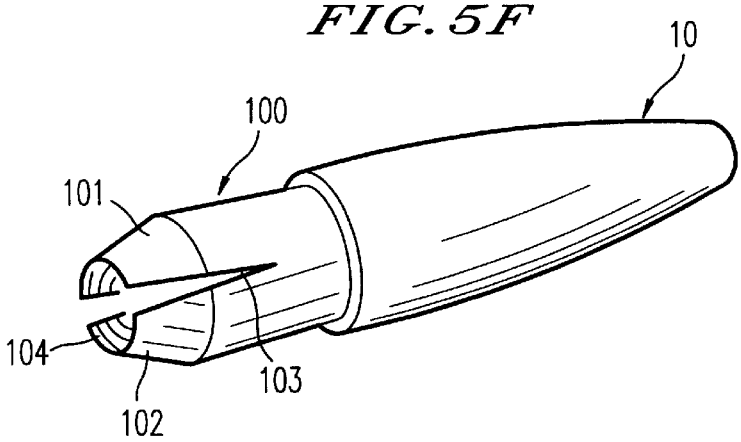
Figure 5G:
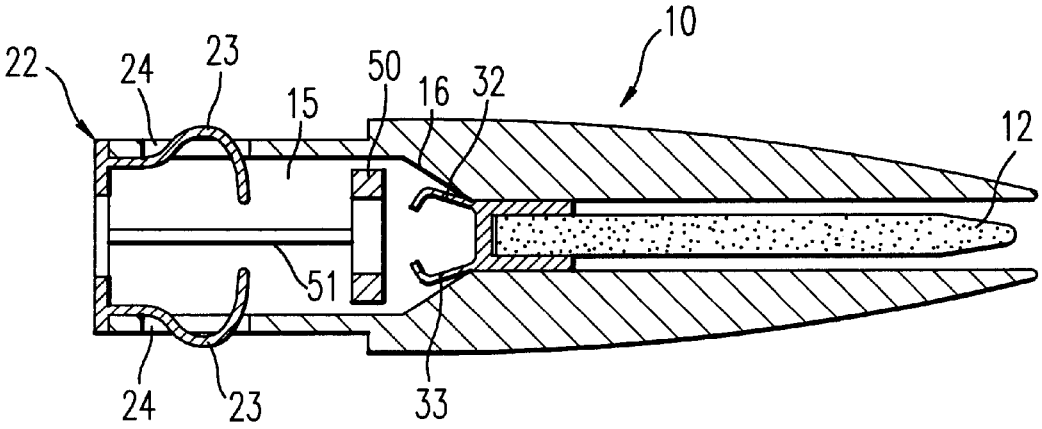

According to another embodiment illustrated in FIG. 5F, the drive of the stem is obtained by means of a slotted threaded screw nut 100 carried by the head. This screw nut has two half shells 101, 102 separated by a slot 103 and whose internal surface comprises at its end a thread 104 capable of cooperating with the thread of the stem. In the same way as in the embodiment with resilient tabs, the slotted nut has a bent shape which gives it the desired resilience for the axial positioning of the applicator. The engagement of the stem is produced when the two parts forming the screw nut are strained by a conical surface arranged in the holder, the removal of the head freeing the two threaded half shells 101, 102 thus producing the disengagement of the stem.

The "lead" 12 is mounted in a cup 14 that will be described in greater detail with reference to FIG. 5A. This cup has a lateral skirt 30, one end of which is open to receive the "lead" and is of a generally cylindrical shape adapted to the shape of the "lead". The internal diameter of the cup is slightly greater than the diameter of the "lead", which can be held in position in the cup by various appropriate means, such as ribs arranged on the internal side of the cup, or by bonding. The other end may be closed by a transverse side 31. On the bottom 31 and on the opposite side to the lateral skirt 30 there are advantageously mounted two fastening tabs 32, 33, made of a preferably resiliently deformable material, so as to move away when at rest from the axis of the cup 30 as shown in FIG. 1. According to an alternative, the tabs are joined to the rest of the cup by a hinge mechanism formed by a zone of lesser thickness at the level of the bottom 31. The shape of the fastening tabs is such that they are capable of tightly holding the end fitting 17 of the stem when the tabs advance into the axial duct 11. According to a preferred embodiment, each one of the fastening tabs substantially defines an L shape.

According to another embodiment, the bottom of the cup is open, at least in part, so as to be capable of allowing the "lead" to be moved into the device through the bottom of the cup before being fitted on the device.

Moreover, even though the fixing of the "lead" forms a preferred feature of the invention so as to allow both the emergence and retraction of the "lead" in the head, this function is nevertheless not indispensable. Indeed, according to a possible embodiment the stem does not have any means for fastening the cup, so that the pencil "lead" is only driven in the emerging direction, and only until it has been completely consumed. In these conditions the removal of the head, for example by pulling, only causes the stem to be freed from the head, and the stem to return to the bottom of the holder, under the effect of the restoring force of the spring. In this configuration, means must be provided for retaining the "lead" inside the duct. By way of example, on the internal surface of the axial duct there may be provided catches capable of cooperating with one or more corresponding elements (stubs or ribs) on the external surface of the cup, the crossing (engagement) of the catches being effected by force under the effect of the thrust of the stem 4. Yet other arrangements may be provided for keeping the lead in position inside the duct.

Figure 3:
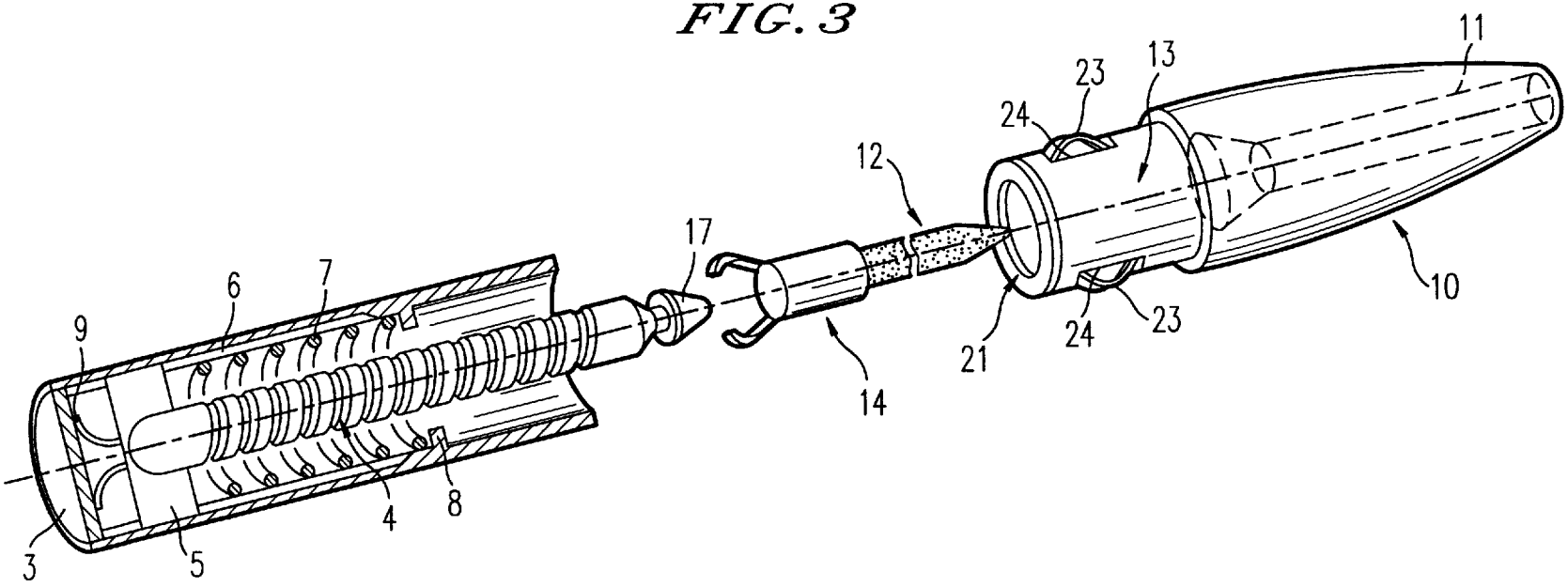
FIG. 3 shows another view of the device shown in FIGS. 1 and 2, wherein the head has been removed from the holder.

The functioning of the device in accordance with the invention will now be explained in greater detail with reference to FIGS. 1 to 3 and 5C. In FIG. 5C the head has been removed from the holder (for instance by pulling). As is shown, the pencil lead has risen again inside the axial duct of the head 10. The fastening tabs 32, 33 are opposite the frustoconical portion 16, and are held to bear against the sides of the frustoconical part by a resilient restoring effect. The drive tabs 23 are in their rest position, that is to say moved away from the axis of the head, the tip of the V defined by them emerging from the part 13 through the holes 24. As is shown in FIG. 3, in the holder 2, the stem 4 carrying the threaded element is held in the restored position against the cap 3 of the holder, thanks to the spring 7.

In the position of FIG. 1 the head 10 is fitted on the holder 2 and the drive tabs 23, strained by the sides of the holder 2, are engaged with the start of the thread of the stem 4. The end fitting 17 of the stem 4 is situated between the fastening tabs 32, 33 of the cup, which tabs are at the level of the frustoconical zone of the duct arranged inside the head, which allows the tabs to diverge outwardly substantially against the frustoconical surface, thus preventing the "lead" from again dropping into the duct. It should be noted that, in the position such as shown in FIG. 1, the head is held elastically in position on the holder by means of the restoring spring, which makes it possible to limit the tightening of the head and holder and to soften the rotation relative to the body of the device, each function being separate.

A rotation of the head relative to the holder causes the stem 4 to advance between the tabs 32, 33 of the cup 14 (FIG. 2). The end fitting 17 then pushes the "lead" into the duct, which causes the tabs 32, 33 to close on the end fitting, thus joining the stem to the cup. The end of the "lead" can thus be caused to emerge from the head with a view to the application of the product. When application has been completed, a rotation of the head 10 in the opposite direction relative to the holder 2, causes the "lead" to be retracted until the tabs 32, 33 are no longer held in position inside the duct, that is to say, until they are situated opposite the frustoconical portion 16. At this moment, the "lead" 12 is no longer joined to the stem 4.

Thus, if in the course of use, the head is removed from the holder (by pulling the head relative to the holder), this causes the "lead" 12 to return inside the duct 11, the drive tabs 23 to move away from the thread of the stem, the stem to be returned to the cap 3 of the holder 2 under the action of the restoring spring 7, detachment of the stem 4 from the "lead" when it has completely returned into the duct 11, and the head to be freed from the body of the holder. Because of this, during use it is very easy to change the product, for example the shade, simply by replacing the head of the device.

Figure 4C:
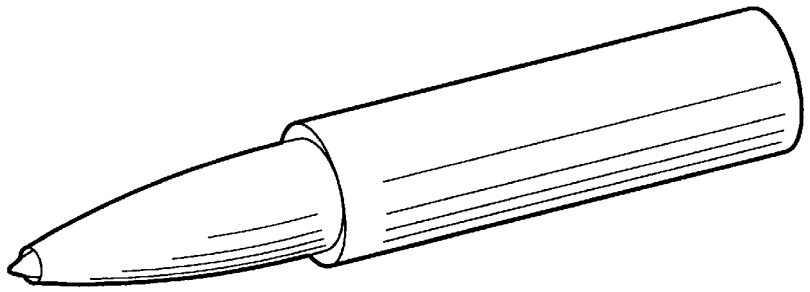
FIGS. 4C–4D show by way of examples two different external shapes of the device in accordance with the invention.
Figure 4D:
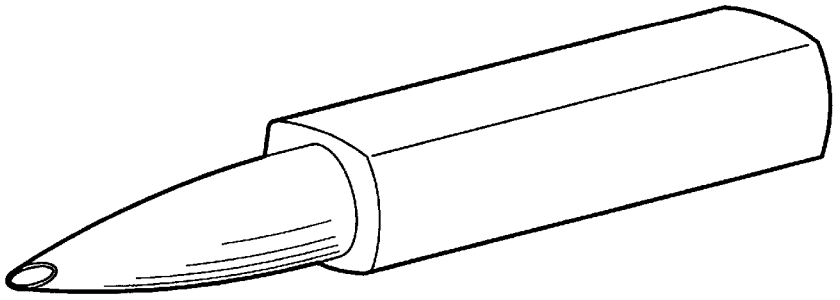

FIGS. 4C and 4D illustrate different forms of the device in accordance with the present invention. In the embodiment of FIG. 4C the cross-section has an oval shape, in that of FIG. 4D the cross-section is substantially square which was difficult to obtain with the conventional devices as discussed in the preamble of the present invention. It is obvious that other forms may be used (triangular, circular, square, polygonal, oval, lozenge-shaped). The dimensions of the cross-section of the device in accordance with the invention are chosen according to the nature of the product to be applied (a lipstick, colouring, eyeshadow etc.).

A flocked coating may be provided, either on the applicator or on the internal sides of the axial duct of the head, so as to limit the play of the applicator in the head of the device. Such a flocked coating may also be disposed on the external surface of the end of the head.

Advantageously again, the device has a protective cap which can be mounted on the head (for example by screwing or by catch engagement) to protect the lead.

Figure 6:
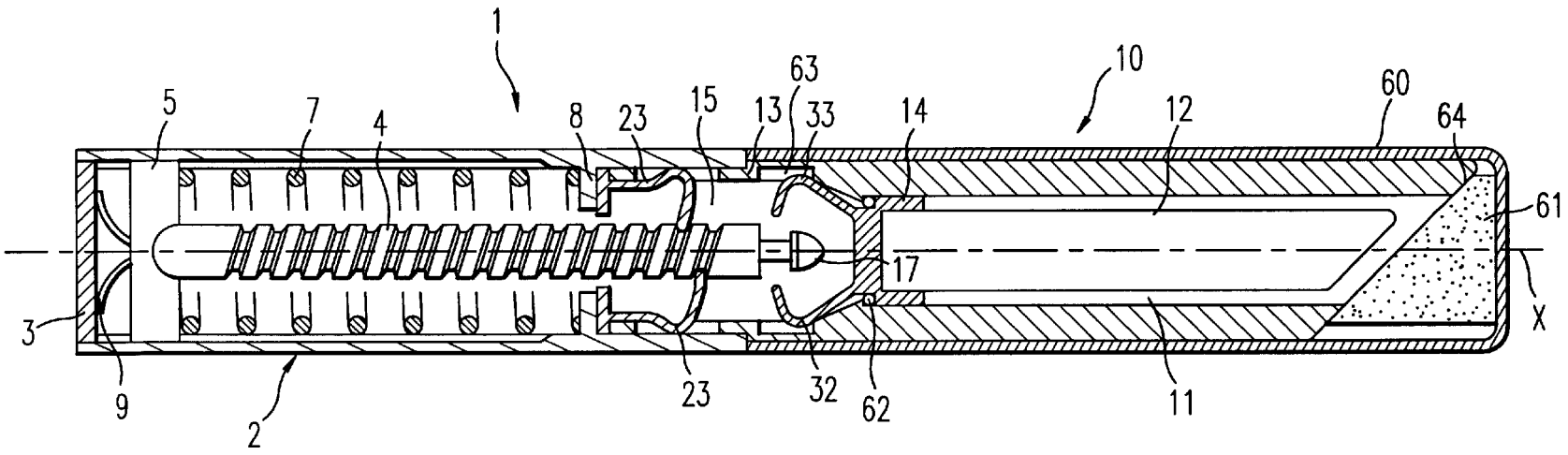
FIG. 6 illustrates a device in accordance with the invention, used for a lipstick.

In FIG. 6, to which reference has now been made, the device in accordance with the invention is used for an applicator 12 in the form of a lipstick. In the same way as in the other embodiments, the lipstick is mounted in a cup 14. Means 62 are provided beneath the cup and/or on the internal side of the axial duct 11 so as to form a seal and/or to form a stop, to prevent the lipstick from dropping out through the opening delimited by the portion with the larger diameter 15. In this latter case, the lipstick can only be mounted in the head through the outlet opening delimited by the free edge 64 of the head. In this embodiment, and given the larger diameter of the applicator and of the cup 14, a groove 63 is provided to allow a sufficient disengagement of the tabs 32 and 33, when the applicator is in its retracted position in the head 10 such as shown in FIG. 6, and to allow the applicator 12 to be separated from the stem 4.

A cap 60 is mounted by catch engagement or screwing on the head 10. A block 61 of foam is disposed in the bottom of the cap to form a seal in the closed position of the cap on the head, the side of the block of foam intended to come to bear on the free edge of the head 10 being impermeable to the solvent (or solvents) contained in the lipstick formula. The block of foam is chosen so as to be in a leakproof contact on the free edge 64 of the head at every point of the said edge, and this irrespective of the profile of the edge (bevelled or straight). Such a device is particularly suitable for formulas with highly volatile solvents. Alternatively, the seal of the free edge 64 is ensured by a sealing skirt obtained by being moulded together with the cap 60.

Figure 7:
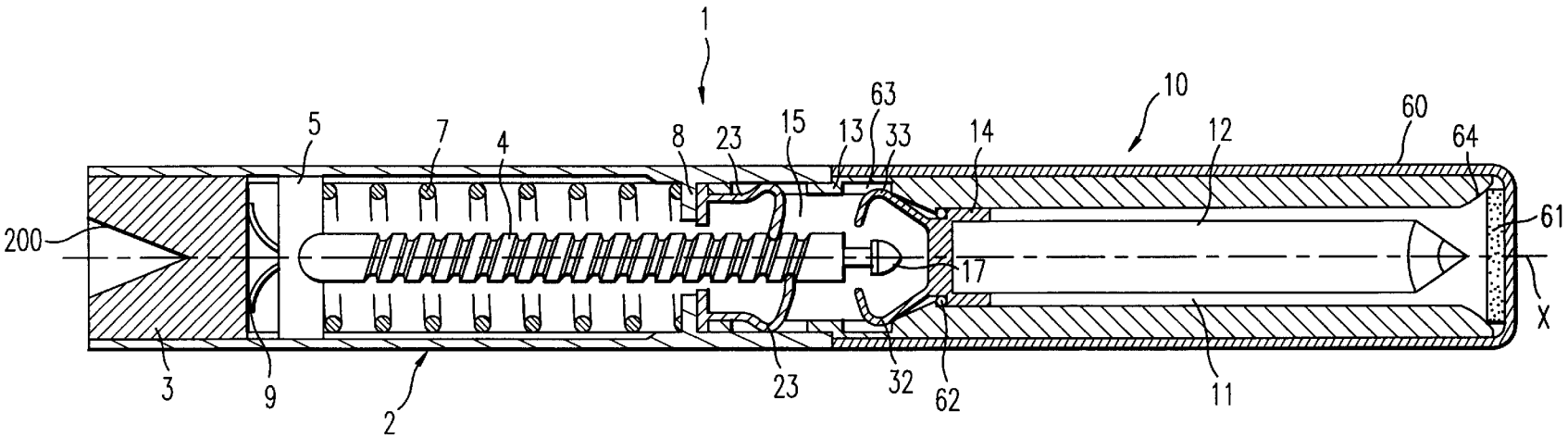
FIG. 7 illustrates a device in accordance with the invention, used for a pencil.

In the preceding detailed description, reference has been made to preferred embodiments of the invention. It is obvious that variants can be introduced into them without departing from the spirit of the invention, such as claimed below. By way of example, it is possible, for example in the case of a pencil, to provide a "pencil sharpener" 200 disposed, for example, in a reinforcement arranged in the cap 3 of the device as depicted in FIG. 7.

What is claimed is:

1. An applicator holder device, comprising a holder having a longitudinal axis (X) and wherein there is mounted a pusher mechanism capable of coming to engage with drive means for selectively passing from a rest position inside the holder to an active position wherein the pusher mechanism is capable of driving an applicator capable of displacement in translation in an axial duct arranged in a head detachably mounted on the holder; and means for automatically producing the disengagement of the drive means from the pusher mechanism when the head is being removed from the holder, and for causing the pusher mechanism to pass from its active position to the rest position under the effect of an axial force exerted by restoring means; characterized in that the drive means have a resilience of which an axial component exerts on the pusher mechanism, when the pusher mechanism is engaged with the drive means, an axial restoring force in a direction opposed to the direction of the axial force exerted by said restoring means, in response to an axial pressure exerted on the pusher mechanism via the applicator.

2. An applicator holder device according to claim 1, characterized in that the drive means are formed by at least one resiliently deformable element, in the form of two portions of which a first portion is joined to the head and is capable of resiliently pivoting, so as to selectively allow during the mounting of the head (or during its removal) the engagement (or the disengagement) of the drive means with, or respectively from, the pusher mechanism, and a second portion joined to the first and capable of coming into an engaged position with the pusher mechanism, and having in said second position an axial resilience for generating said axial restoring force.

3. An applicator holder device according to claim 2, characterized in that in said engaged position, the first portion is substantially parallel to the axis X, the second portion forming an angle relative to the first.

4. An applicator holder device according to claim 3, characterized in that the second portion forms an angle relative to the first from 30° to 120°, and preferably from 45° to 110°.

5. An applicator holder device according to claim 2, characterized in that the resilience of the second portion is such that under the effect of an axial pressure exerted via the applicator, the pusher mechanism is axially displaced by a distance of from 0.2 mm to 2 mm.

6. An applicator holder device according to claim 2, characterized in that the second portion has a radial width of from 1.5 mm to 3 mm.

7. An applicator holder device according to claim 1, characterized in that the drive means comprise at least two tabs capable of coming into engagement with the pusher mechanism at at least two diametrically opposite points.

8. An applicator holder device according to claim 7, characterized in that said tabs substantially have the shape of an L or a V whose apex is orientated towards the outside of the holder, corresponding holes being arranged in a lateral side of the head for freeing said tabs during the removal of the head and for thus producing the disengagement of the tabs from the pusher mechanism.

9. An applicator holder device according to claim 1, characterized in that the drive means are arranged so as to produce their disengagement from the pusher mechanism and to cause the pusher mechanism to pass from its active position to said rest position when the axial pressure exerted on the pusher mechanism exceeds a given value.

10. An applicator holder device according to claim 1, characterized in that it comprises:

a) a hollow cylindrical holder closed at one of its ends;

b) a stem threaded over at least a part of its length and mounted for free translation inside the holder, said stem being secured against rotation inside the holder;

c) elastic restoring means mounted inside the holder so as to keep the threaded stem in the rest position biased against the closed end of the holder;

d) a detachable head wherein an axial duct is arranged, intended to receive an applicator mounted in a cup, said duct being open at its two ends, the first end opening out towards the outside for the application of the product, and the second end allowing the head to be detachably fitted on the holder;

e) drive means carried by the head or by the holder so as to be placed into engagement with the thread of the stem when the head is being mounted on the holder, so as to produce the driving of the applicator in translation in said duct by rotation of the holder relative to the head, and f) means for permitting the disengagement of the drive means and of the stem during the removal of the head.

11. An applicator holder device according to claim 10, characterized in that the stem is threaded over a portion delimited by a first limit situated on the opposite side to the closed end of the holder, and a second limit, the drive means comprising a meshing end capable of coming into engagement with the thread of the stem, said meshing end being positioned in such a way that during the mounting of the head on the holder, the meshing end is substantially opposite the first limit.

12. An applicator holder device according to claim 10, characterized in that it comprises coupling means between the stem and the applicator, with a view to driving the applicator into the axial duct of the head; and in that the mounting of the head on the holder produces the engagement of the driving system with the threaded stem but does not produce the driving of the applicator in the duct, the applicator only coming into play during the first use of the device, by rotation of the head relative to the holder.

13. An applicator holder device according to claim 12, characterized in that the coupling means comprise at least two resiliently deformable tabs mounted on the cup, said tabs having a shape capable of tightly gripping the end fitting of the stem when it pushes the applicator inside the duct.

14. An applicator holder device claim 10, characterized in that, at its opposite end to the closed end of the holder, the stem has a fastening end fitting; in that the cup has fastening means intended to cooperate in a detachable manner with the fastening end fitting of the stem, so as to allow the applicator to be driven into the said duct, in that rotation of the holder relative to the head causes the applicator to be driven in translation in said duct and the stem to be fastened to the cup by the closing of the fastening means on the said end fitting, the rotation of the holder in the opposite direction relative to the head causing the applicator to rise again in the duct; and in that means are provided for releasing the stem from the cup by opening the fastening means when the applicator has risen again inside the duct, while keeping the applicator in position inside the duct.

15. An applicator holder device according to claim 14, characterized in that the means provided for releasing the stem from the cup comprise a frustoconical portion formed inside the head, adjacent to the said axial duct, the said frustoconical portion allowing the fastening means to diverge by being resiliently biased when they arrive opposite the said frustoconical portion, thus releasing the stem.

16. An applicator holder device according to claim 15, characterized in that the means provided for releasing the stem from the cup further comprise a groove adjacent to the frustoconical portion, so as to allow the fastening means to diverge further.

17. An applicator holder device according to claim 10, characterized in that at its opposite end to the head, the stem has guide means capable of sliding inside a groove arranged in the internal side of the holder.

18. An applicator holder device according to claim 17, characterized in that means are disposed between the guide means of the stem and the closed end of the holder, so as to dampen the impact of the stem on the bottom of the holder during the return of the stem under the action of the elastic means.

19. An applicator holder device according to claim 18, characterized in that the means are carried by the guide means of the stem and/or by a bottom forming the closed end of the holder.

20. An applicator holder device according to claim 18, characterized in that the means are formed by a leaf spring obtained by moulding together with the piece of which they form part, by an overmoulded elastomeric element, or by a block of foam.

21. An applicator holder device according to claim 10, characterized in that the closed end of the holder has an attached bottom, the said bottom having an opening for the escape and/or renewed intake of air.

22. An applicator holder device according to claim 21, characterized in that the attached bottom is catch engaged, bonded, welded or screwed on.

23. An applicator holder device according to claim 10, characterized in that the said elastic restoring means comprise a helical spring disposed inside the holder.

24. An applicator holder device according to claim 23, characterized in that one end of the spring bears against the guide means of the stem, the other end bearing against an annular flange disposed on the internal side of the holder.

25. An applicator holder device according to claim 10, characterized by means forming a stop, for limiting the axial movement of the applicator in the direction towards the second end of the head, in the detached position of the head.

26. An applicator holder device according to claim 25, characterized in that tabs are carried by an annular element intended to be mounted on the head, said element also carrying the means intended to form a stop for the said applicator.

27. An applicator holder device according to claim 26, characterized in that the annular element is formed by a single piece obtained by moulding a thermoplastic material.

28. An applicator holder device according to claim 10, further comprising a drive system includes a slotted screw nut carried by the head.

29. An applicator holder device according to claim 1, characterized in that the drive means are carried by the head of the device.

30. An applicator holder device according to claim 1, characterized in that sealing means are provided in the vicinity of one or the other of the ends of the axial duct.

31. An applicator holder device according to claim 30, characterized in that the sealing means comprise a block of foam compressible in all spatial directions and having one side intended to come into a leakproof bearing contact on a free edge of the head, said one side being impermeable to the solvent (or solvents) forming part of the composition of the applicator, said block of foam being disposed in the bottom of a cap capable of covering in a detachable manner an opening delimited by the said free edge.

32. An applicator holder device according to claim 1, characterized in that on the opposite end to the head, the holder carries a pencil sharpener.

33. An applicator holder device according to claim 1, characterized in that the holder has a square, oval, triangular, circular or polygonal cross-section.

34. An applicator holder device according to claim 1, characterized in that the applicator is formed by a lead, a pencil brush, a felt, a lipstick, a foam or a flocked applicator.

35. An applicator holder device according to claim 1, characterized in that the product to be applied is a lipstick, a colouring, a mascara, a liner, a kohl, an eyeshadow etc.

36. An applicator holder device, comprising a holder having a longitudinal axis;

a head having an axial duct, the head being configured to mate with the holder;

at least one resilient element mounted to the head;

a pusher mechanism mounted within the holder, the pusher mechanism being configured to mate with an applicator capable of displacement within the axial duct, the pusher mechanism being configured to engage with the at least one resilient element and drive the applicator within the axial duct from a rest position inside the holder to an active position; and a resilient member positioned within the holder, the resilient member being configured to provide an axial force to the pusher mechanism such that the applicator is biased in a direction towards the rest position, wherein, when the pusher mechanism is engaged with the at least one resilient element and when an axial pressure is exerted on the pusher mechanism via the applicator, the at least one resilient element has a resilience such that the at least one resilient element exerts an axial restoring force on the pusher mechanism in a direction opposite the direction of bias of the applicator.

* * * * *